US005161884A

United States Patent [19]

Siminovitch

[11] Patent Number: 5,161,884

[45] Date of Patent: Nov. 10, 1992

[54] THERMAL ELEMENT FOR MAINTAINING MINIMUM LAMP WALL TEMPERATURE IN FLUORESCENT FIXTURES

[75] Inventor: Michael J. Siminovitch, Richmond, Calif.

[73] Assignee: The Regents of the University of California, Oakland, Calif.

[21] Appl. No.: 516,767

[22] Filed: Apr. 30, 1990

[51] Int. Cl.[5] ..... F21V 29/00

[52] U.S. Cl. ..... 362/294; 362/218; 362/373; 165/46; 313/44

[58] Field of Search ..... 362/218, 294, 373, 345; 313/22, 24, 36, 44; 165/461

[56] References Cited

U.S. PATENT DOCUMENTS

| | | | |
|---|---|---|---|
| 2,425,599 | 8/1947 | Cox | 313/22 |
| 3,965,345 | 6/1976 | Fordsmand | 362/218 |
| 4,563,375 | 1/1986 | Ulrich | 165/46 X |

*Primary Examiner*—Stephen F. Husar

[57] ABSTRACT

In a lighting fixture including a lamp and a housing, an improvement is disclosed for maintaining a lamp envelope area at a cooler, reduced temperature relative to the enclosed housing ambient. The improvement comprises a thermal element in thermal communication with the housing extending to and springably urging thermal communication with a predetermined area of the lamp envelope surface.

12 Claims, 7 Drawing Sheets

THERMAL ELEMENT FOR MAINTAINING MINIMUM LAMP WALL TEMPERATURE IN FLUORESCENT FIXTURES

The invention described herein arose in the course of, or under, Contract No. DE-AC03-76SF00098 between the U.S. Department of Energy and the University of California.

BACKGROUND OF THE INVENTION

1. Field of the Invention

This invention relates to fluorescent lighting fixtures and particularly to methods for cooling of lamps operating within fixtures.

2. Description of the Prior Art

Although various methods for cooling fluorescent lighting lamps are known in the art, they are excessively complex, and employ heat exchangers or associated apparatus such as Snelling, U.S. Pat. No. 3,112,890. Or they mask off the entire top portion of the lamp with a top cooling conduit such as Fordsmand, U.S. Pat. No. 3,869,606 and thus severely reduce light output by the amount normally radiated by the top portion of the lamp.

Moreover, prior art methods require special, expensive fixture designs, require additional external connections and piping to the fixture, and need external support systems. Prior art structures make routine bulb changes difficult and time consuming for untrained maintenance personnel who may not be familiar with complex systems. Accordingly, unless the lamp replacement and refitting of control apparatus is carefully carried out by trained personnel, operational performance with the new lamp will be poor or certainly less than optimum.

Thus there is clearly a need for an improved, high performance method and structure for establishing and maintaining cooler fluorescent lamp operating temperatures within standard, easily serviced fixtures.

SUMMARY OF THE INVENTION

A thermal element is provided for cooling and maintaining minimum lampwall temperatures in fluorescent fixtures of the type utilizing a lamp and a generally enclosed heat conductive housing. The element is an improvement for maintaining a fluorescent lamp envelope surface area at a predetermined temperature, such as the optimum design temperature.

A thermal element provides thermal communication with the fixture housing by extending to and springably urging thermal communication with a predetermined area of the lamp envelope surface. By placing the warmer, predetermined area of the lamp envelope in communication with the cooler housing and outside environment, the lamp can be brought to and maintained at the optimum design temperature for highest light output and efficacy.

DETAILED DESCRIPTION OF THE PREFERRED EMBODIMENTS

In broad overview, the present invention utilizes a thermal element as a thermal bridge to thermally couple a predetermined area of a fluorescent lamp envelope to a lower temperature at the fixture body which is exposed to ambient air. Establishing a predetermined lower temperature at a small predetermined area on the envelope, as is well known in the art, allows the lamp to be maintained at the optimum design temperature. Unfortunately, the prior art suggests excessively complex methods and structures to establish control and to cool fluorescent lamps.

Control of a small area or spot on the envelope is all that is necessary because the light output and efficacy is not determined by the lamp wall temperature, but rather by the vapor pressure within the lamp, which varies as a function of minimum lamp wall temperature. In an enclosed or semi-enclosed lamp fixture, overheating results from excessive heat trapped in the enclosure, and to a lesser extent when the ambient air temperature around the fixture rises. The result is a sharp drop in light and efficacy as lamp envelope temperature rises.

Figure 1:
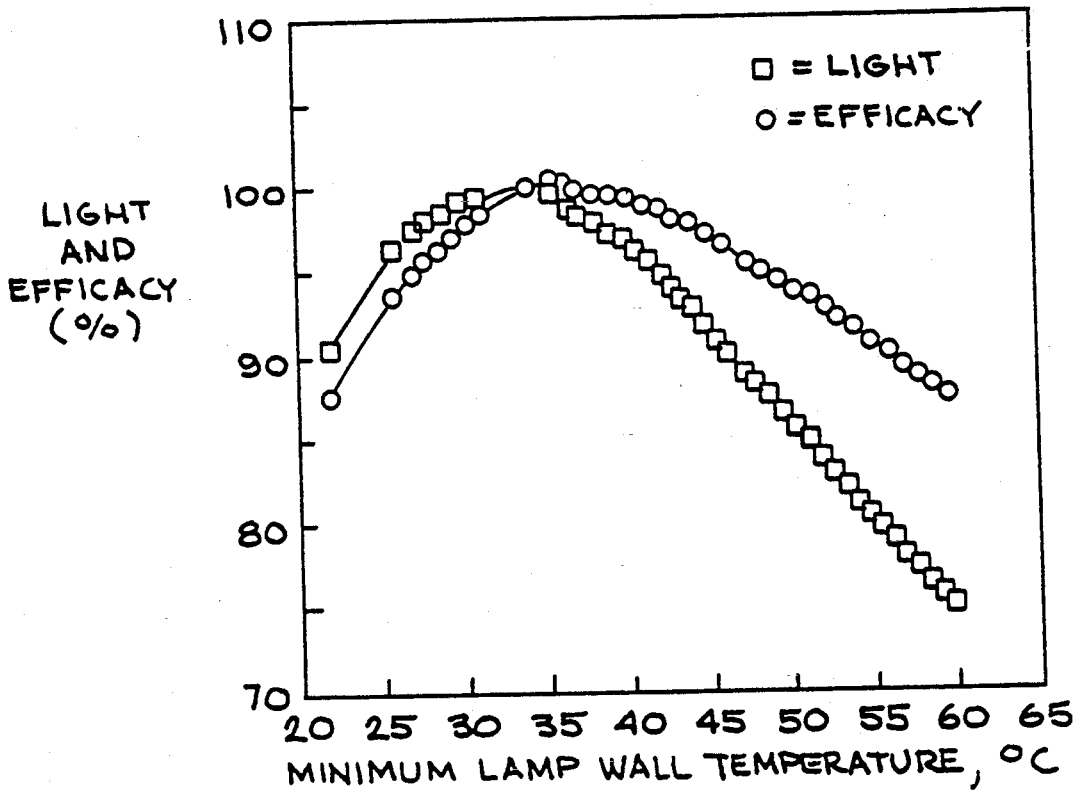
FIG. 1 (PRIOR ART)
FIG. 1, a graphical presentation, shows lamp light output and efficacy for the prior art.

Referring to FIG. 1, the sharp drop in light and efficacy with temperature can be appreciated. The optimum design temperature, that is, the minimum lamp wall temperature (MLWT), in the range of 35–40 degrees Centigrade provides the maximum light and efficacy. Light output drops sharply to 80 percent with a 20 degree increase in temperature which could easily occur in a warm environment, particularly with the lamp generated heat trapped within the fixture.

Figure 2A:
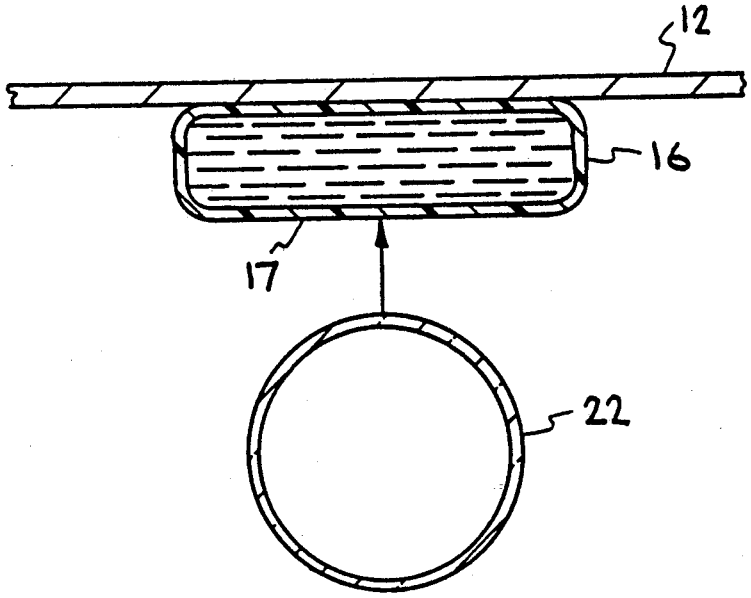
FIG. 2A, a partial cross-sectional view, shows a lighting fixture including the invention prior to lamp installation.
Figure 2B:
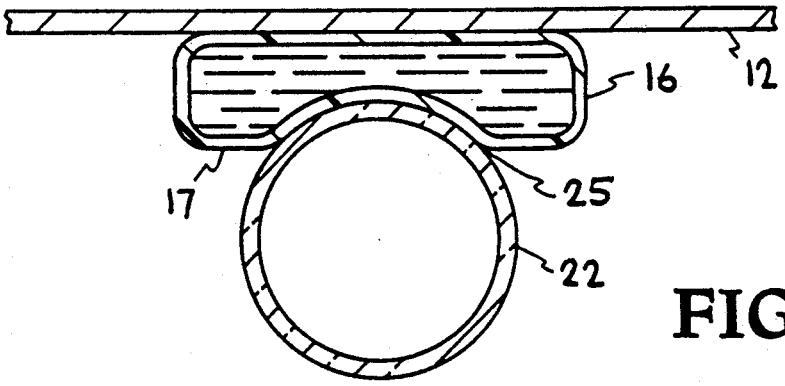
FIG. 2B shows the invention after lamp installation.

Referring to FIGS. 2A and 2B, an end cross-sectional view of the invention is shown. Although not critical, the cross-section can generally be midway along the lamp elongate envelope. Lamp fixture wall 12 carries a thermal element or bridge comprising a thermally conductive and convective flexible bladder 16, affixed in thermal communication with the underside of wall 12 and with a portion 17 of the bladder distending downward. Lamp 22 is shown prior to positioning within the fixture and engagement of the lamp contact pins with the sockets of the fixture. Bladder 16 contains a fluid type material which with temperature differential, from one portion to another, sets up convection currents within the contained material. The currents of course aid in the convective cooling process.

More specifically bladder 16 comprises a conformable envelope capable of containing a predetermined fluid. The bladder wall may be a heat communicating foil alone or formed over a membrane such as relatively thin plastic or other suitable material. For example, an outside surface foil may contact directly an inside liner foil such as by apertures formed in the plastic wall. The wall may comprise a flexible plastic web having spaced communicating apertures for the outer foil to directly contact and conductively communicate with the liner foil. Within the inner envelope foil a predetermined, convectively communicating fluid is carried, such as glycol, water, oil, glycerine or any fluid that will set up convection currents when exposed to temperature differential. The material may comprise a semi-paste composition so long as substantial liquid-convective paths extend from wall to remote wall across the element. Traversing the cooling path, the outer surface which touches the lamp conductively communicates foil to foil with the inner wall fluid which then convectively conmmunicates via the fluid to a remote wall which, in turn, conductively communicates foil to foil with the fixture wall or body. Optimally, a minimum area surface contact is established on the lamp surface and a maximum contact surface area on the fixture body or wall.

Turning to installation, when the lamp is merely positioned in the fixture and rotated to seat the end contact pins as in routine servicing and replacement, the thermal element of the present invention is formed, FIG. 2B. The previously downwardly distended portion 17 of bladder 16 is urged upward and caused to conform to a portion 25 of the outer surface envelope of lamp 22. The resultant, intimately shaped and sculptured to fit, bladder element establishes a highly communicative path from the higher temperature bulb portion 25, extending to the lamp fixture wall. Thus portion 25 on the bulb is set at and tracks the fixture wall and corresponding outside ambient air temperature.

In operation, element 16 maintains a relatively uniform temperature throughout from top to bottom. The temperature of the fixture housing, and outside air, is communicated within the housing through the thermal element and is preserved and maintained at the predetermined outer surface envelope portion 25 of lamp 22. As was previously discussed from FIG. 1, the step of providing a decreased MLWT at the lamp surface ensures that the lamp design optimum conditions are met and thus both light and efficacy increase.

Figure 3A:
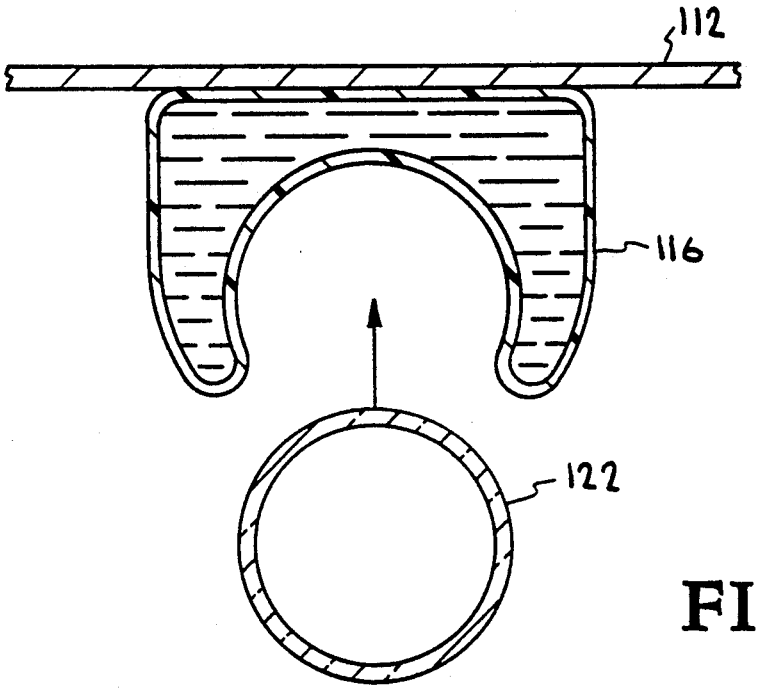
FIG. 3A, a partial cross-sectional view, shows a lighting fixture including the invention prior to lamp installation.
Figure 3B:
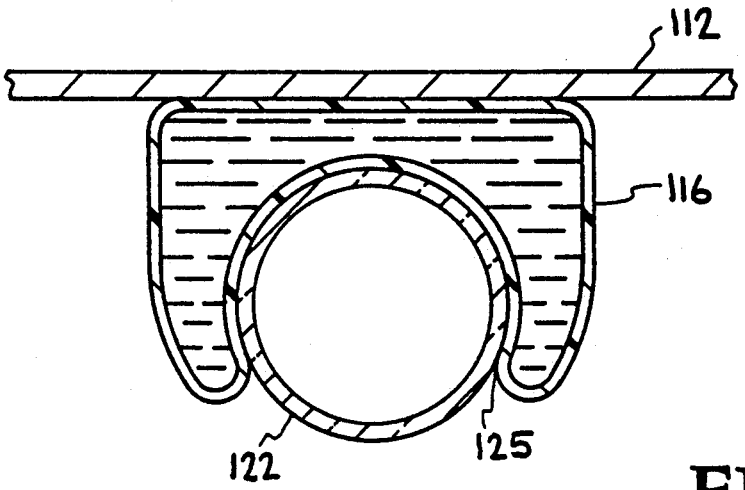
FIG. 3B shows the invention after lamp installation.

In certain fixtures, the lamp may not rotate about end contact pins as in FIG. 2B, but may be pushed directly into and be carried by the fixture unassisted by the rotating detent contact pins and companion sockets. An alternative arrangement of the invention for this type fixture is shown in FIGS. 3A and 3B. Thermal element 116 is formed of semirigid material, such as molded plastic, and contains a conductive and convective fluid or paste material as previously disclosed. Additionally, element 116 is adapted to receive and clamp a portion 125 of the outer envelope of lamp 122. Installation includes merely pressing the lamp upward into the fixture housing to engage end electrical contacts and cause the resilient thermal element to spread and physically engage the bulb, thus establishing and maintaining thermal communication from the area 125 to housing 112.

Figure 4:
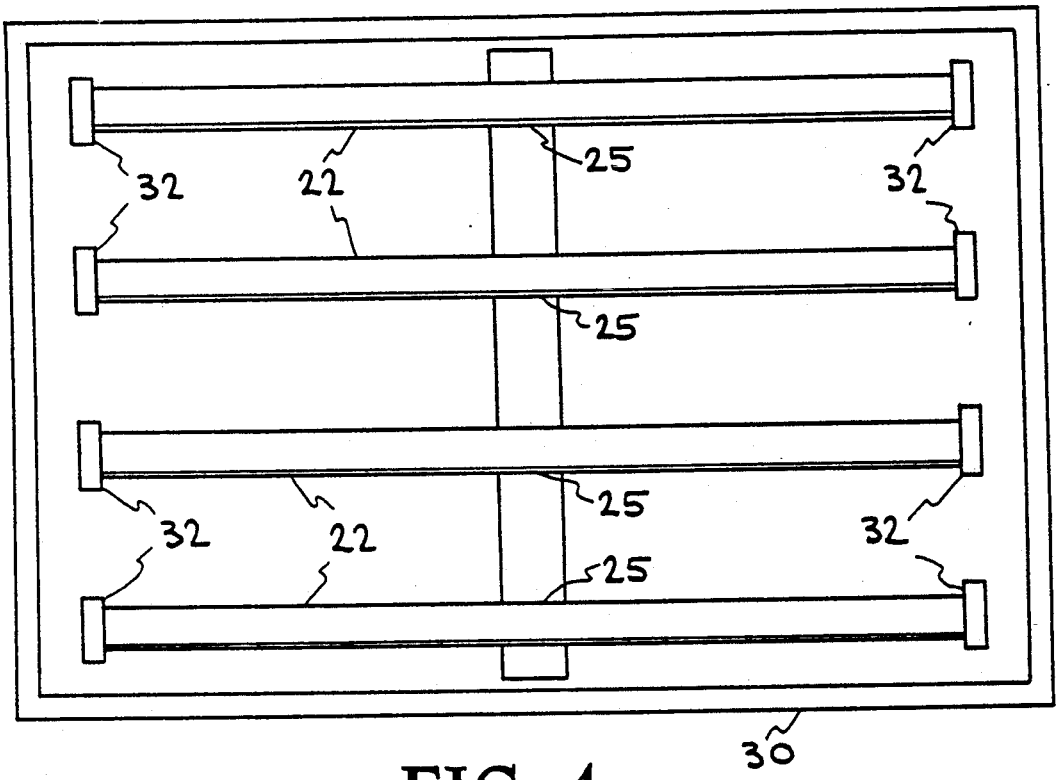
FIG. 4, an underside view of a overhead mounted fixture, shows the invention in combination with plural lamps.

Only a predetermined heat dissipation strip having plural portions 25 is required to realize the improvement for plural lamps in a combination fixture, FIG. 4. Plural lamps 22 extend end to end carried by a combination fixture 30. Appropriate sockets 32 affixed to the fixture body 30, receive the end contacts of the respective lamps 22 and generally space the lamps across the breadth of fixture 30. Although the strip having plural portions 25 is shown positioned midway between the lamp ends, it may be relocated along the extent of the bulb envelopes at any predetermined location where creation of the MLWT is desired. In general, the midpoint is the coolest location on the lamp during operation and thus needs the least assistance from the invention to bring a given lamp envelope location to the outside fixture housing temperature. Of course, the strip and portions thereof may be offset or rearranged for the various lamps with no effect on operation for manufacturing or installation convenience.

Figure 5:
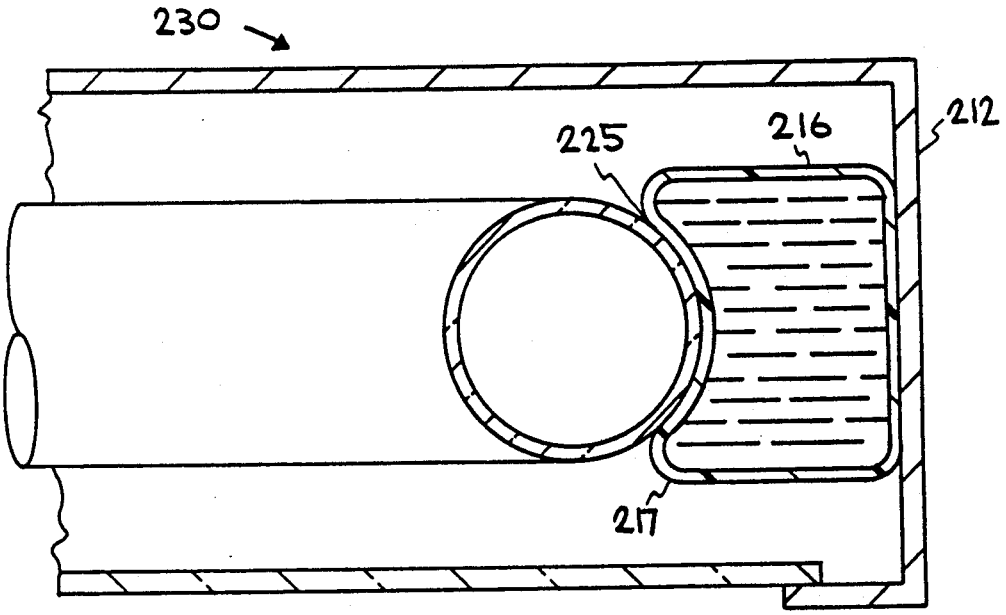
FIGS. 5 and 6, partial cross-sectional views, show alternative embodiments of the invention coupled respectively to side and louver portions of the fixture housing.

Referring to FIG. 5, an alternative side communicating thermal element is shown. Lamp fixture side wall 212 of the fixture 230 carries a thermal element including a thermally conductive and convective flexible bladder 216, affixed in thermal communication with the sidewall 212 and with a portion 217 of the bladder normally distending inward and downward. When the lamp is positioned in the fixture and electrical contacts engaged, the bladder is again urged upward and outward toward the housing wall thereby causing conformance to the lamp portion 225. Thus a highly communicative thermal path is established from the higher temperature bulb portion 225 to the fixture wall 212 and the corresponding outside ambient air temperature. The embodiment of FIG. 5 may be most useful for "U" shaped lamps having the element positioned at the bend in the lamp and remote from the bulb end contacts.

Figure 6:
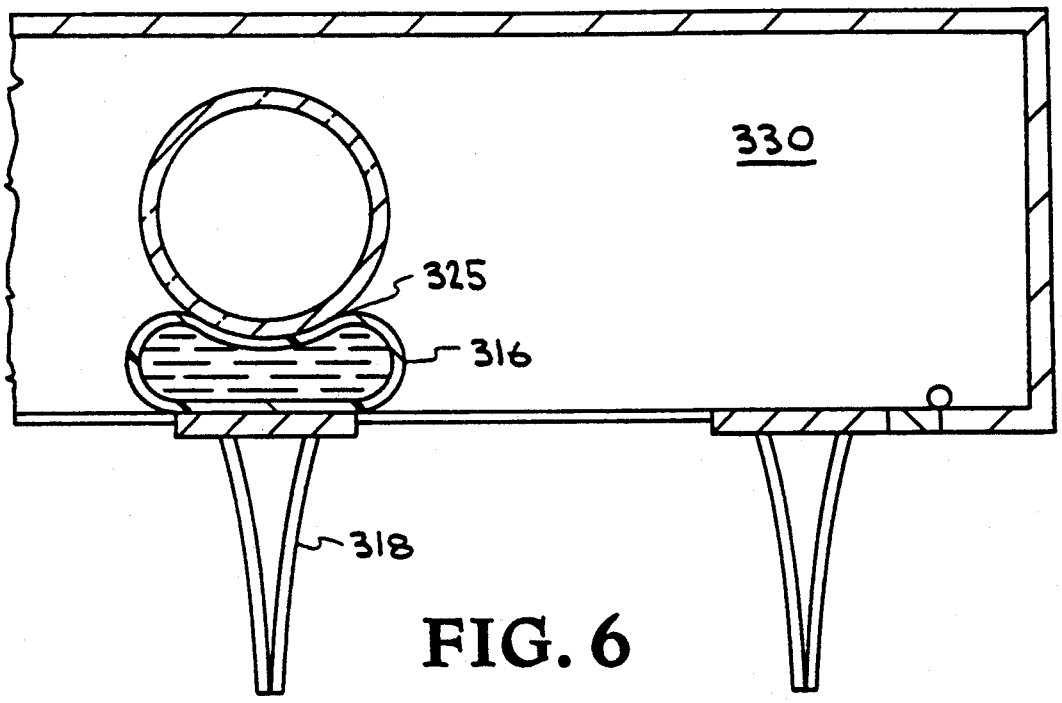

It should be appreciated that the thermal element may be repositioned within the fixture to communicate from the lamp to the top, side or bottom portion of the housing so long as a communicating path is established from the warmer lamp envelope to a cooler housing (and outside ambient) temperature. For example in a fixture 330 having a metal louver lens system, FIG. 6, the element 316 may be affixed to the louver 318. When the louver is swung into place and closed, the thermal element will by design reach upward to flexibly and variably conform to the lamp envelope at area 325 thereby establishing the improved thermal communication path from bulb to louver and thence to outside fixture ambient.

Figure 7A:
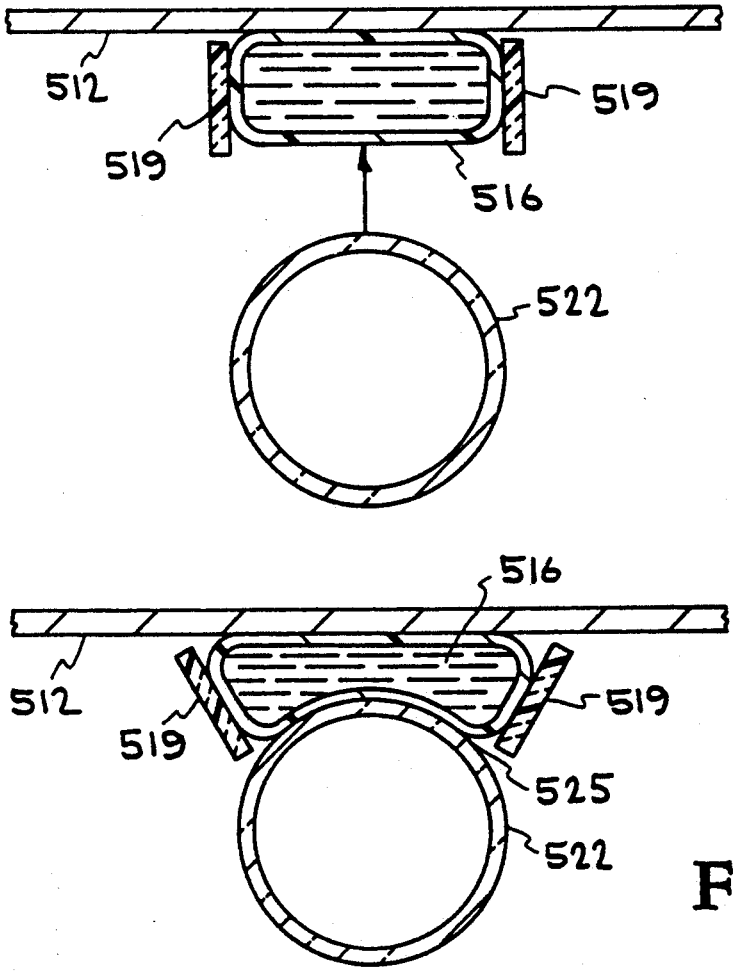
FIGS. 7A, 7B and 7C, partial cross-sectional views, show the invention together with additional temperature isolation means within the fixture.
Figure 7B:
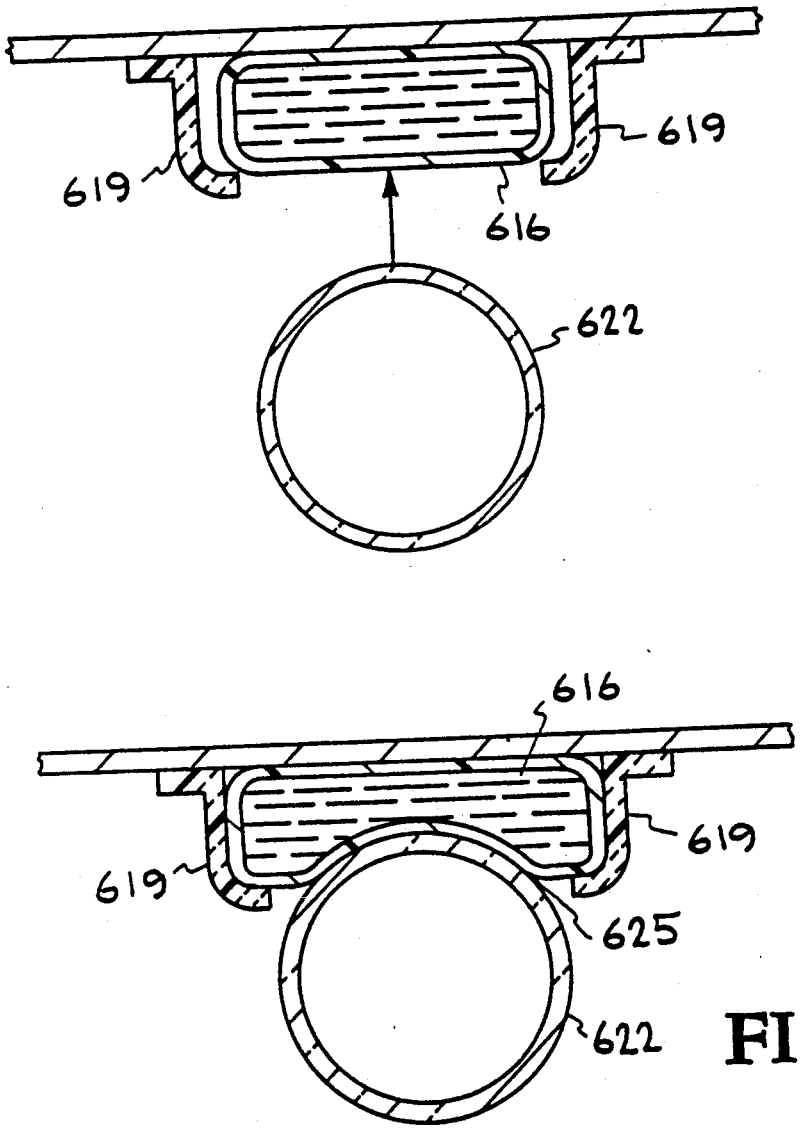
Figure 7C:
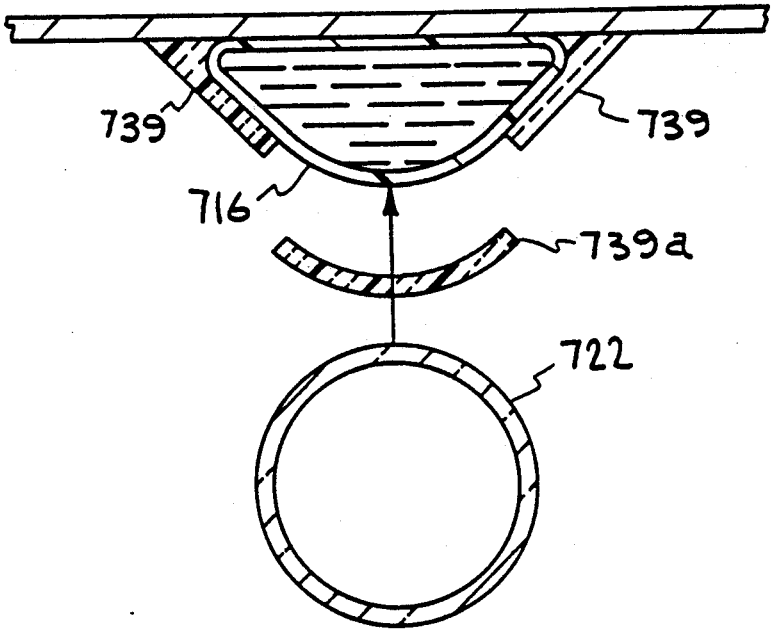
Figure 7C:
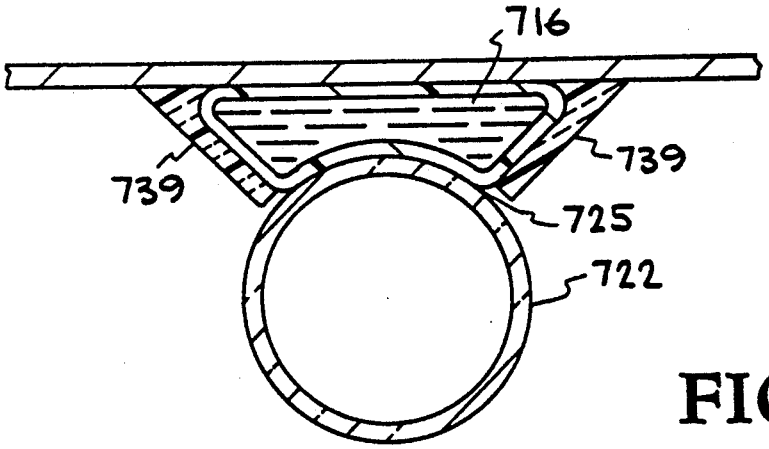

Although the thermal element itself is relatively small as it extends from lamp surface to fixture wall, the unprotected sides of the element are nonetheless exposed to the elevated temperatures within the fixture. Referring to FIGS. 7A, 7B and 7C respectively, conformal side insulating strips, sleeving, or a shell can be incorporated in combination with the element to maintain the thermal communication ability of the element as it extends through the high temperature ambient constrained within the fixture. In FIG. 7A, conformal insulating side strips 519 protect the element side walls from undesired heating. As the lamp is pressed into the fixture, the strips spread, follow and define the side walls of the bladder or element 516 to thereby variably adjust to the space between the bulb and the housing. With predetermined design dimensions, substantially all the side walls are protected, with minimum ambient exposure.

Referring to FIG. 7B, the element 616 in communication with the housing is further positioned within an insulating sleeve 619. When the lamp 622 is pressed into the fixture, the side walls of the sleeve 619 permit the lamp to conform to the bladder or element at areas 625 and maintain sidewall ambient protection. FIG. 7C shows a continuous insulating shell 739 formed on the thermal element 716. The lamp 722 is first pressed temporarily in place and the prospective contact surface determined. Next the shell portion 739*a* at the contact surface 725 is removed thereby forming a precisely positioned cooling aperture exposing only the required contact portion of 716. Thus maximum protection is provided, and installation variables are easily accommodated.

ILLUSTRATIVE EXAMPLE

Figure 8:
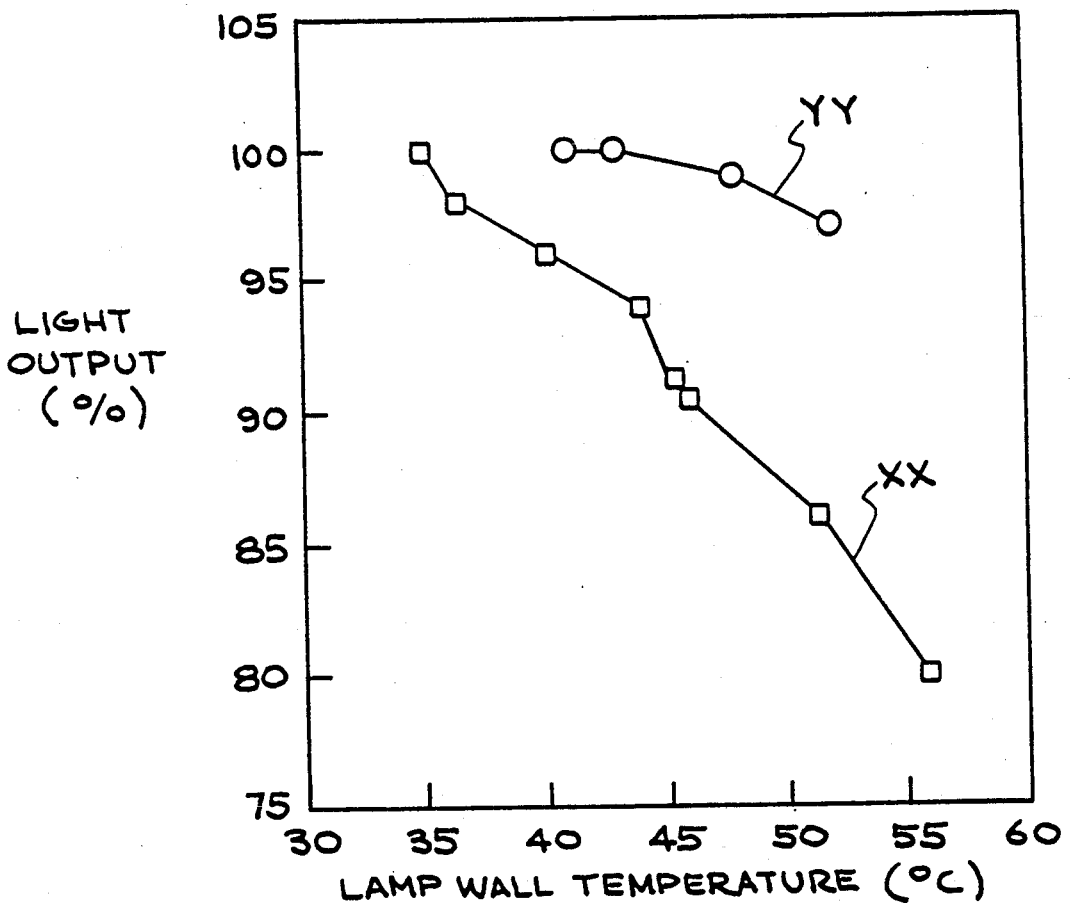
FIG. 8, a graphical presentation, shows the improvement realized in carrying out the disclosed illustrative example.

Referring to FIG. 8, experimental data was measured and plotted utilizing lamp apparatus described as in FIG. 2A and 2B. Within a temperature controlled chamber, a thermally equivalent fixture comprising a 1 foot by 1 foot by 4 foot volume including one T12-F40 lamp was measured. For reference, the lamp was measured without the thermal element to determine light output as a function of temperature. Data defining curve XX was measured and plotted referenced to 100% light output at 35 degrees Centigrade MLWT. As can be seen, at approximately 52 degrees light output decreased to about 86%. Output fell further to 80% at 56 degrees. Next, a thermal element comprising a thermal conductive foil packet containing a Perfluorocarbon liquid was placed between the lamp surface and the housing. It is believed that the packet could contain any of the preivously mentioned bladder fluids, but the specific Perfluorocarbon fluid used is one sold by Minnesota Mining and Manufacturing, "3M", as Fluorinert(trade mark) liquid heat sink. Data defining curve YY was measured and plotted. Again with the same reference, at a lamp wall temperature (LWT) of approximately 52 degrees light output decreased only slightly to 97%. The result is a substantial improvement of approximately 11–15%, with further increase expected with improved thermal coupling to the housing as well as to the lamp surface.

Summarizing, without the thermal element light output is greatly reduced with the reduction brought about by the increasing lamp temperature within the fixture. Applying the invention, light is maintained at or near optimum over a wide range of normal lamp wall temperatures using the thermal element. Under normal temperature conditions light output would be increased by approximately 15%, and perhaps more with optimization, with the contribution of the thermal element. Clearly, substantial enhancement in light output has been realized.

Thus it is apparent that a thermal element for maintaining minimum lamp wall temperature in fluorescent fixtures has been provided. Moreover, the thermal element greatly enhances cooling and maintains lamp envelope surface area at a predetermined temperature, such as the optimum design temperature, and thereby provides highest light output and efficacy.

I claim:

1. In a lighting fixture including a lamp and a housing, an improvement for maintaining a lamp envelope area at a cooler reduced tempe relative to the enclosed housing ambient comprising, a flexible thermal element in thermal communication with the housing extending to and springably urging thermal communication with a predetermined area of the lamp envelope surface.

2. A thermal element a in claim 1 wherein the element includes a thermally conductive bladder comprising a flexible envelope carrying a thermally conductive and convective fluid or paste.

3. A thermal element a in claim 1 wherein the element includes a compressible pad formed of relatively fine thermally conductive mesh.

4. A thermal element as in claim 3 wherein the pad includes a conductive surface area for communication with the predetermined area of the lamp envelope surface.

5. A thermal element as in claim 1 wherein the element includes a thermally conductive and convective foam.

6. A thermal element as in claim 1 wherein the element comprises semirigid clamping means for receiving and carrying the lamp within the fixture housing.

7. A thermal element as in claim 1 together with a thermal insulating sleeve covering the exposed side wall portions of the element for isolating the element from the fixture internal operating temperature.

8. A thermal element as in claim 1 together with thermal insulating strips covering the exposed side wall portions of the element for isolating the element intermediate body portions from the fixture internal operating temperature.

9. A thermal element as in claim wherein the element is enclosed within a thermal insulating shell having apertures formed therein permitting thermal communication between the lamp envelope surface and the outer portion of the lamp housing.

10. The thermal element of claim 1, wherein said element is so configured that the envelope temperature is maintained at 35° –40° C.

11. The thermal element of claim 1, wherein said element is springably urged at the mid-point of the lamp envelope.

12. The thermal element of claim 1, where said element is urged upon a small area of the lamp envelope.

* * * * *